US007204738B2

(12) United States Patent
Collins et al.

(10) Patent No.: US 7,204,738 B2
(45) Date of Patent: Apr. 17, 2007

(54) METHOD OF FORMING A METAL HALIDE DISCHARGE TUBE AND APPARATUS THEREFORE

(75) Inventors: Kent Collins, Hammondsport, NY (US); Thomas Steere, Hornell, NY (US)

(73) Assignee: Koninklijke Philips Electronics, N.V., Eindhoven (NL)

( * ) Notice: Subject to any disclaimer, the term of this patent is extended or adjusted under 35 U.S.C. 154(b) by 324 days.

(21) Appl. No.: 10/792,625

(22) Filed: Mar. 3, 2004

(65) Prior Publication Data

US 2004/0263081 A1 Dec. 30, 2004

Related U.S. Application Data

(60) Provisional application No. 60/482,715, filed on Jun. 27, 2003.

(51) Int. Cl.
*H01J 9/00* (2006.01)

(52) U.S. Cl. ..... 445/26; 445/27

(58) Field of Classification Search ..... 445/26, 445/27

See application file for complete search history.

(56) References Cited

U.S. PATENT DOCUMENTS

| | | | | |
|---|---|---|---|---|
| 4,765,820 | A * | 8/1988 | Naganawa et al. | 65/36 |
| 4,808,882 | A * | 2/1989 | Parker et al. | 313/625 |
| 4,987,028 | A * | 1/1991 | Kandachi et al. | 428/312.6 |
| 5,592,048 | A * | 1/1997 | Wei et al. | 313/570 |
| 6,274,982 | B1 * | 8/2001 | Scott et al. | 313/624 |

* cited by examiner

*Primary Examiner*—Nimeshkumar D. Patel
*Assistant Examiner*—Anthony Canning

(57) ABSTRACT

A method of forming a metal halide discharge tube comprises: arranging a tubular body (110) in an essentially vertical orientation; disposing a loose-fit T-plug (100) having a cylindrical portion (106) and an annular flange (104) in an upper open end of the tubular body (110) so that the cylindrical portion (106) of the T-plug (100) is disposed within the open end of the tubular body (110) in a contact-free, spaced relationship with an inner wall of the tubular body and with the annular flange (104) seating against an annular top end edge surface (108) of the tubular body (100); and firing the tubular body and the loose-fit T-plug to shrink fit the tubular body and the loose-fit T-plug to interfuse the loose-fit T-plug with the upper end of the tubular body in a manner which results in a unitary/monolithic body.

16 Claims, 6 Drawing Sheets

METHOD OF FORMING A METAL HALIDE DISCHARGE TUBE AND APPARATUS THEREFORE

CROSS REFERENCE TO RELATED APPLICATIONS

This application claims the benefit of Provisional Application Ser. No. 60/482,715, filed Jun. 27, 2003.

The present invention relates generally to high-pressure discharge lamps and more specifically to an improved method and structure for manufacturing the same.

A high-pressure discharge lamp includes a ceramic discharge vessel which encloses a discharge space containing two electrodes and an ionizable filling including a metal halide. The discharge vessel includes a central cylindrical part having open ends. These open ends each have a plug disposed therein to form a monolithic body and hermetically close same. A feed through conductor passes through at least one of the projection plugs.

The manufacture of Ceramic discharge metal halide (CDM) in polycrystalline alumina (PCA) tubes conventionally requires a five piece design where two interim parts, referred to as T-plugs, are made to just fit inside the body. This arrangement is exacting, time consuming and does not result in efficient production.

IN THE FIGURES

In these figures "CRI" stands for "color rendering index"—the higher the CRI the more "true" colors will appear. "CCT" stands for "correlated color temperature", and is expressed in degrees Kelvin. The lower the CCT the "warmer" (orange to yellowish-orange) the color of the light. The higher the CCT the "cooler" (white to bluish-white) the color.

Figure 1:
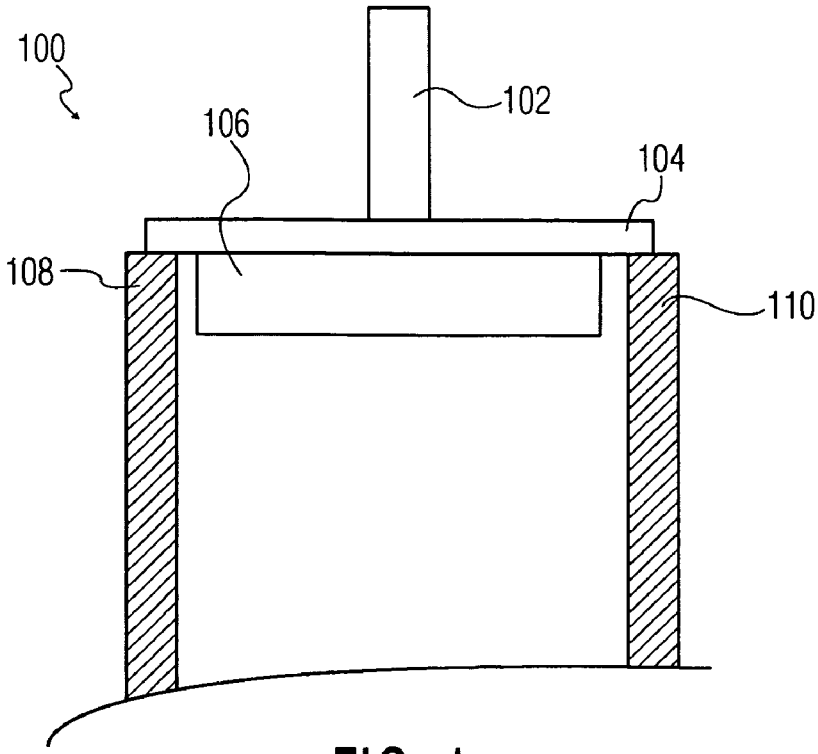
FIG. 1 is a schematic cross-sectional elevation of a 'top hat' type T-plug which is used to close the open ends of a cylindrical CDM body.

The present invention is direct to a technique which enables the rapid firing and production of ceramic metal halide discharge tubes. This technique involves the use of a loose-fit T-plug 100 which is provided with a stem member 102, and an annular flange 104 that extends out beyond a cylindrical portion 106 of the T-plug 100. This flange 104, as shown in FIG. 1 is such as sit on top of the annular top end 108 of a tubular body 110. The plug which closes the lower end of the tubular body 110 is also a loose-fit T-plug 100'.

The flange 104 has a thickness which is less than that of the cylindrical portion 106 and which is on the order of 1–4 mm. The upper and lower T-plugs are produced separately. The stem 102 and the cylindrical portion 106 are fitted together and thin ring, which becomes the "brim" (flange 104) of what is seen as resembling a "top hat" type of arrangement, is fitted over the stem 102 and seated on the upper side of the cylindrical portion 106. These three elements are set together, fired and interfused ("interfused" is herein taken to mean—softened and merged/blended) to become a single unitary or monolithic component. In one embodiment of the invention, before firing, the clearance between the cylindrical portion 106 and the inner wall of the tubular body is selected to be between 0.2 and 0.4 mm. Alternatively, the brim (104) and cylindrical portion (106) can be formed together in a "one piece" monolithic form by a number of means such as machining, pressing, or injection molding. This is additionally true for the stem (102), brim (104) and cylindrical portion (106).

While it will be noted that the lower T-plug 100' need not be provided with a flange 104 such as is provided on the upper T-plug 100. However, in the embodiment the same type of plug is used at both ends of the tubular body in that this reduces the number of different parts which are involved in the production of and must be stored and kept track of in connection with the production of this high pressure vessel.

In this embodiment, the upper and lower plugs 100, 100' and the tubular body 110 are made of ceramic material such as polycrystalline alumina.

The upper and lower loose-fit T-plugs 100, 100' function as "thermal buffers" during the firing process and reduce the amount of stress and resultant failures which occur during production, on the body 110. This "thermal buffering" is a result of the T-plugs (100) being pre-fired and densified compared to the body portion (110). The denser T-plug (100) can absorb and diffuse heat faster because the thermal conductivity of the denser T-plug plug is higher. This equalizes temperature gradients from the inside to the outside of the body (110) reducing stress.

The embodiment of the invention enables the firing to be carried out very rapidly. In conventional arrangements it is necessary to raise the temperature of the bodies at a low rate such as exemplified by 50–100° C./per minute and as low as 5° C./minute, in order to avoid developing thermal stresses which lead to cracks and failures in the final product. With the embodiment of the invention, it is possible, due to the thermal buffering effect provided by the top hat configuration, to raise the temperature much more rapidly, on the order of 1000° C./minute, and still achieve a very low failure rate.

The embodiment of the invention is therefore well suited to being placed on a conveyor and passed into a furnace where it rapidly undergoes firing and interfusion which results in a unitary component being produced.

Figure 2:
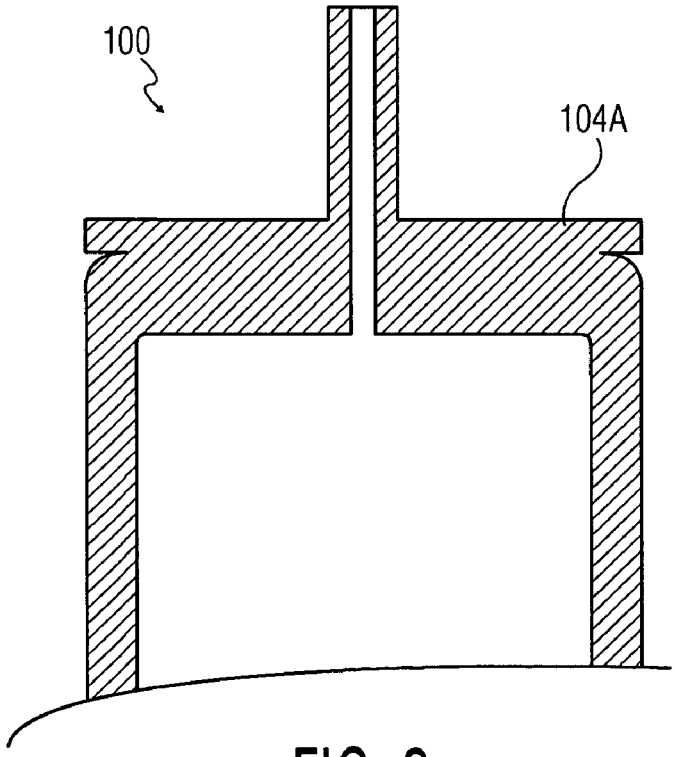
FIG. 2 is a schematic cross-sectional elevation showing the arrangement which results from the heat treatment of the arrangement shown in FIG. 1.
Figure 3:
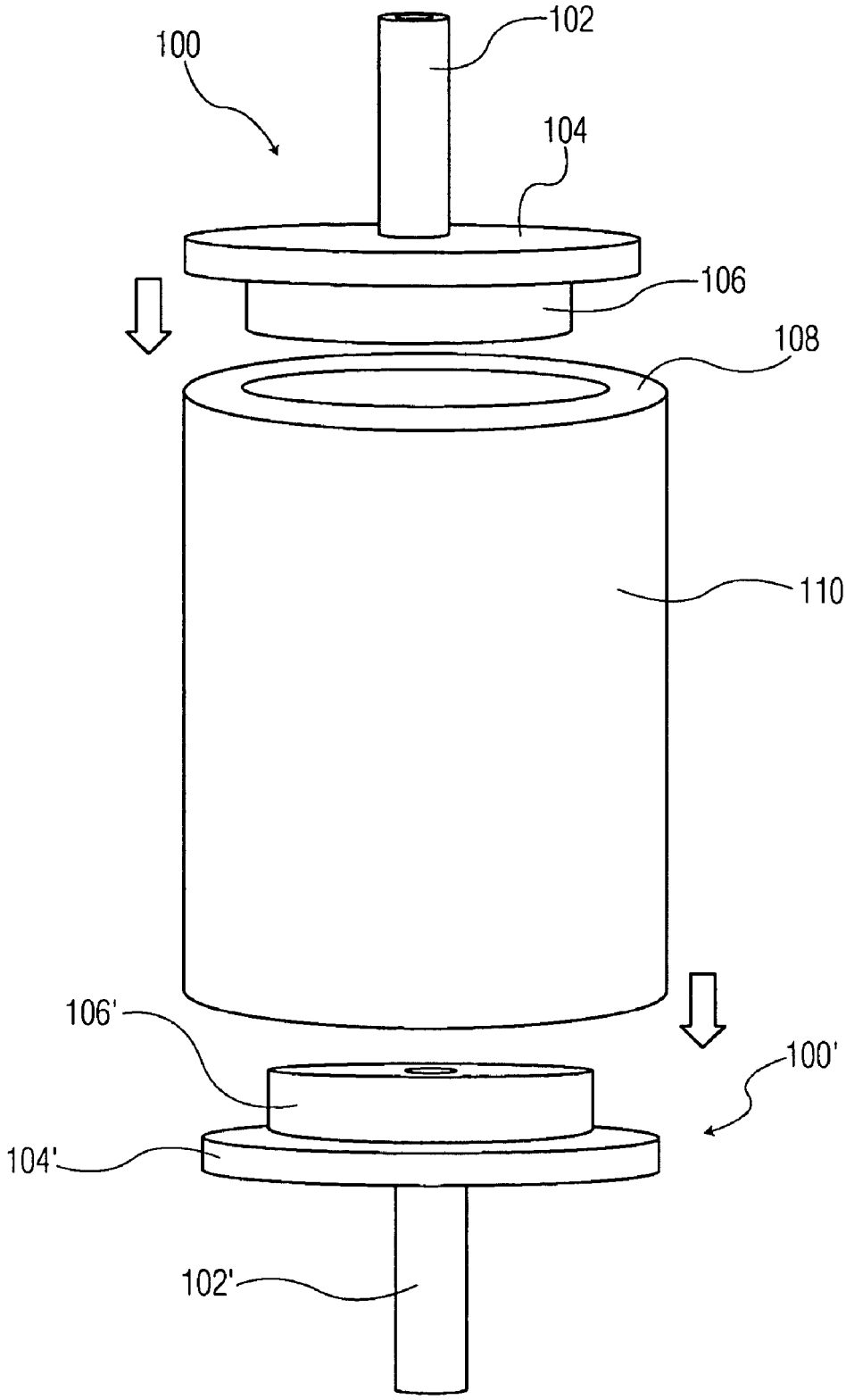
FIG. 3 is an exploded view showing how the cylindrical/tubular body is assembled with the upper and lower loose-fit T-plugs.

FIG. 2 shows the result of firing the arrangement shown in FIG. 1. As will be appreciated, all of the components shrink during the heating process. The tubular body 110 shrinks in and engages the cylindrical portion 106 and initiates interfusion. As the process continues, the interconnection, which is established between the tubular body 110 and the cylindrical member 106, is drawn down away from the annular flange 104 by the shrinkage and thus tends to leave outermost peripheral portion 104A of the annular flange 104 slightly separated from the remainder of the body in the manner illustrated in FIG. 2. Nevertheless, a stable monolithic body is produced.

Figure 4:
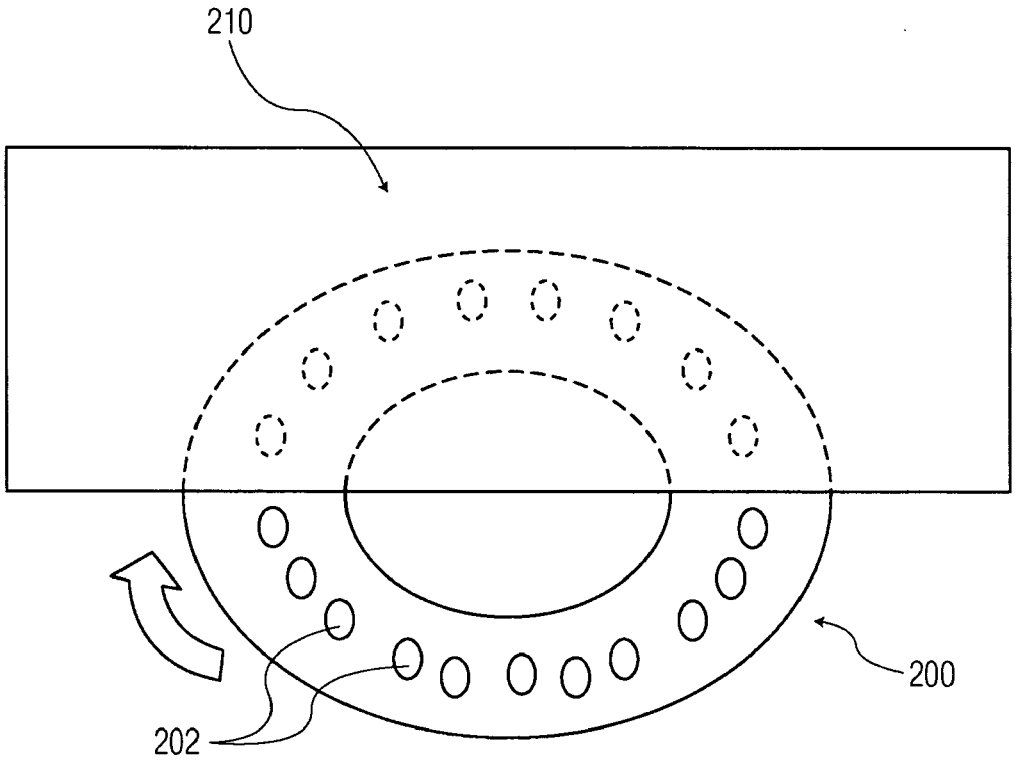
FIG. 4 is a schematic plan view showing a conveyor belt and furnace arrangement which is used to heat and interfuse the cylindrical body and the upper and lower loose-fit T-plugs.
Figure 5:
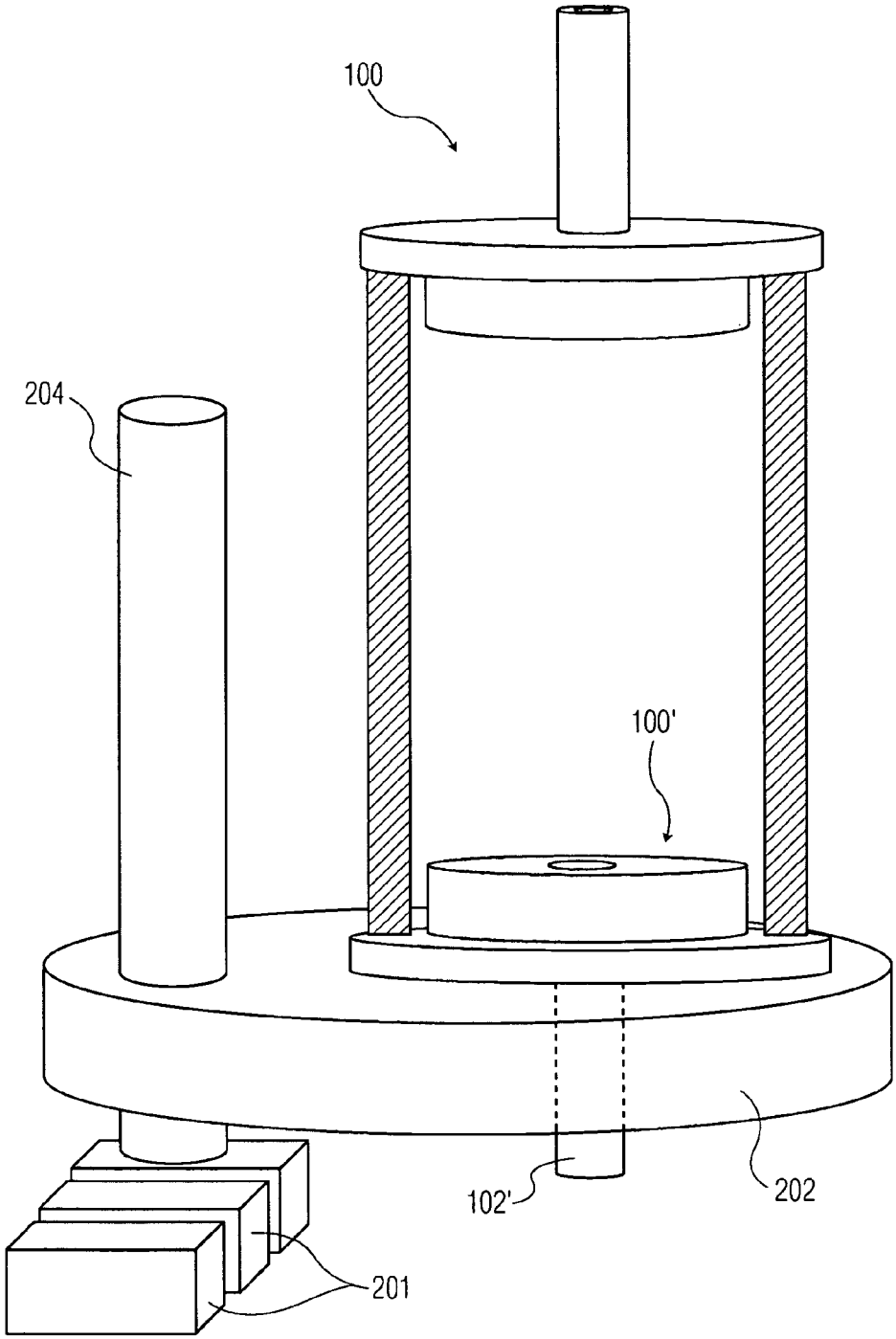
FIG. 5 is a schematic perspective view showing an assembled cylindrical body and the upper and lower loose-fit T-plugs disposed on a pallet which forms part of the conveyor belt depicted in FIG. 4.
Figure 6:
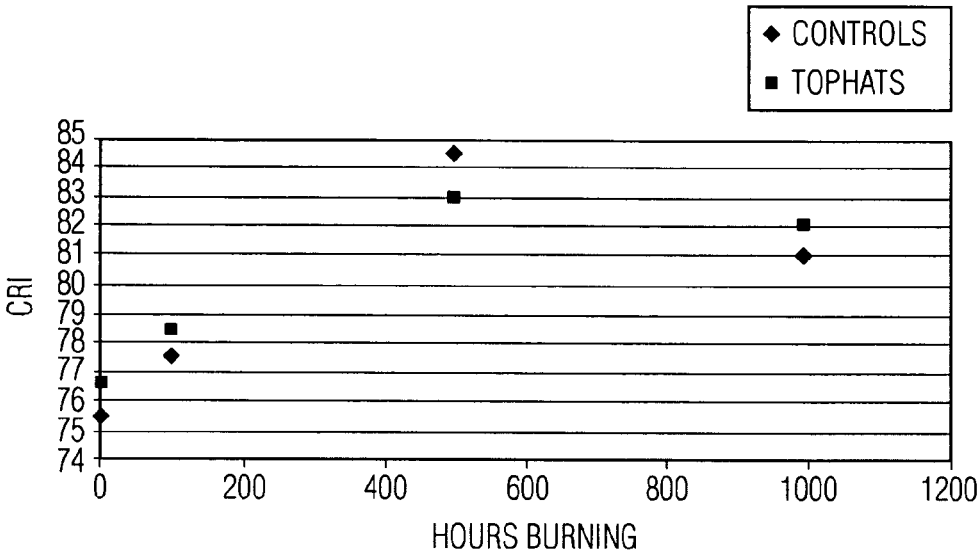
FIGS. 6–9 are graphs which demonstrate the characteristics which are achieved with the production method that utilizes the structure and arrangements depicted in FIGS. 1–5.
Figure 7:
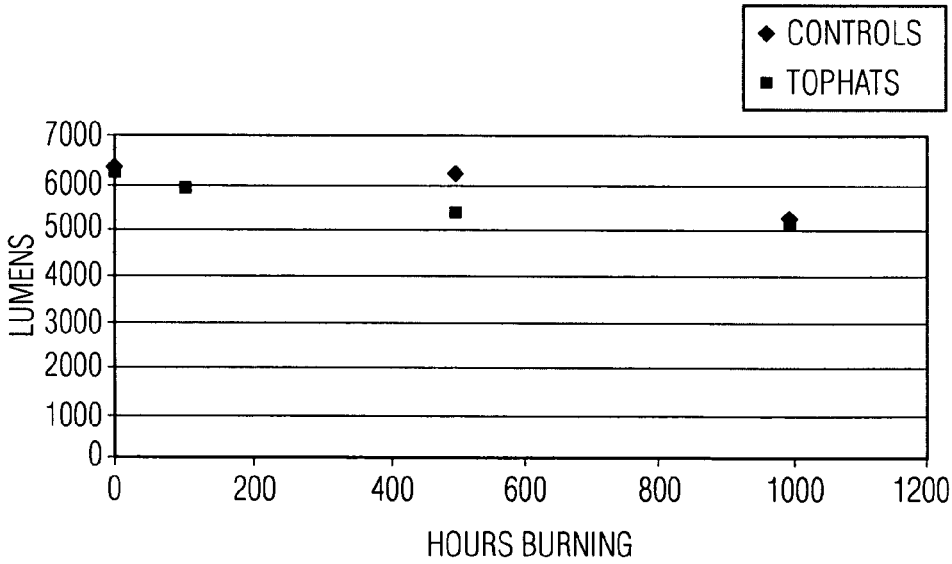
Figure 8:
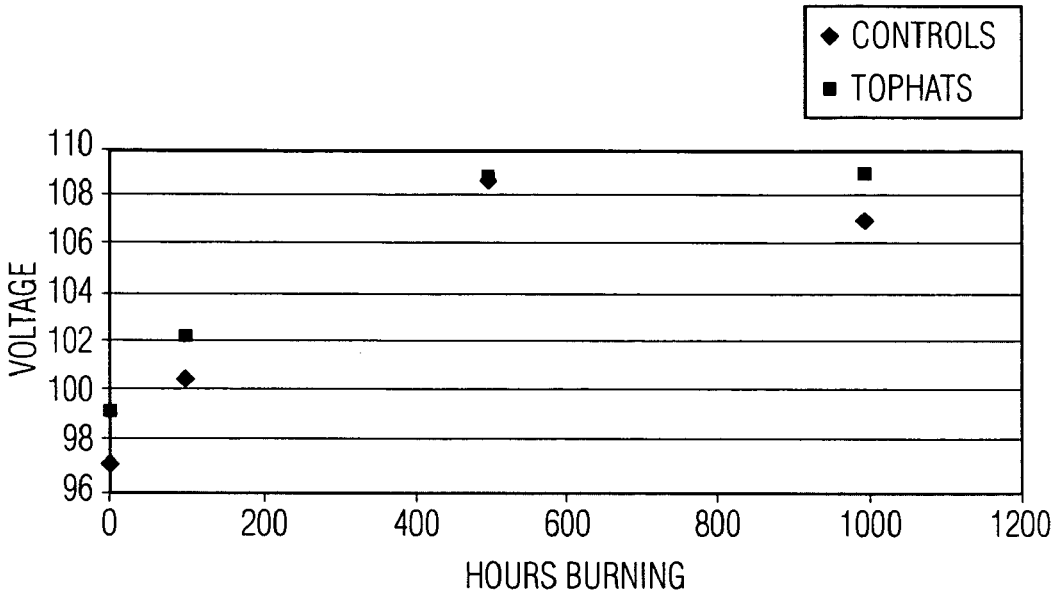
Figure 9:
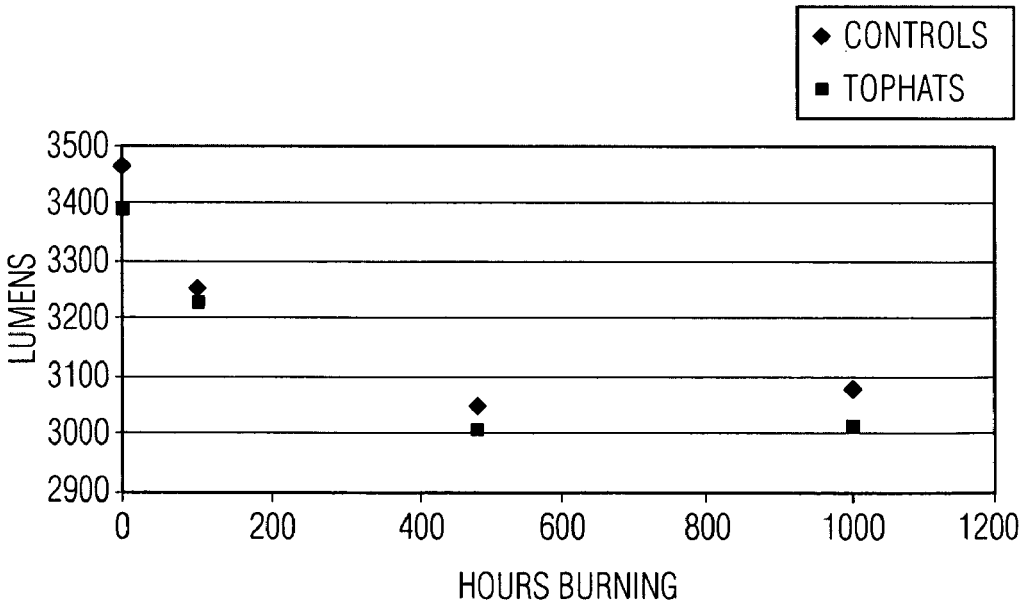

FIG. 4 schematically shows a conveyor 200 and a furnace 210. The conveyor 200, as schematically shown in FIG. 5, has a link arrangement 201 upon which pedestals or nests 202 are each supported so as to be pivotal about a vertical shaft 204. Each pedestal has a through hole which is adapted to receive the stem 102' of the lower T-plug. The pedestal is made of a material which is similar in thermal characteristics to that from which the T-plugs and other components are made, and thus also acts as a thermal buffer and effects the heating of the components which are placed thereon in a manner which facilitates defect free production. In this embodiment, the belt components and pedestals are all made of an aluminum based material which has been sintered to develop a density close to that at which the final products of the sintering process which takes place in the furnace 210.

With this arrangement, a lower T-plug 100' is disposed on a pedestal with the stem 102' disposed through the aperture therein. The tubular body 110 is then set on the lower T-plug 100' and finally, the upper T-plug 100 is set on the upper end of the tubular body 110. The conveyor is then activated and used to move the assembly of the upper and lower T-plugs 100, 100' and the tubular body 110, into the furnace 210.

Upon emerging from the furnace, the three components have interfused into a single monolithic body.

Testing data pertaining to the product which results using the above technique/structures, is given in FIGS. 6–9 and Table as set forth below. Inasmuch as this data will self-explanatory to the person of skill in the art to which the present invention pertains, no further description will be given for the sake of brevity.

TABLE

| Hours burned | Lumens Controls | Top Hats | Voltage Controls | Top Hats | CCT Controls | Top Hats | CRI Controls | Top Hats |
|---|---|---|---|---|---|---|---|---|
| 0 | 6383 | 6259 | 97 | 98.9 | 3462 | 3387 | 75.4 | 76.7 |
| 100 | 5946 | 5893 | 100.3 | 102.1 | 3247 | 3225 | 77.6 | 78.4 |
| 500 | 6184 | 5348 | 108.4 | 108.5 | 3044 | 3002 | 84.4 | 83 |
| 1000 | 5282 | 5127 | 106.8 | 109.0 | 3079 | 3011 | 80.9 | 82 |

Test #
Controls n = 5
Top Hats n = 4

Although the description of the exemplary embodiments of the present invention have been given with reference to only one embodiment, the various changes and modifications which can be made without departing from the scope of the present invention which is limited only by the appended claims, will be readily envisaged.

The invention claimed is:

1. A method of forming a metal halide discharge tube comprising:

arranging a tubular body in an essentially vertical orientation;

disposing a first loose-fit T-plug having a stem portion, a cylindrical portion and an annular flange in an upper open end of the tubular body so that the cylindrical portion of the first loose-fit T-plug is disposed within the open end of the tubular body in a contact-free, spaced relation with an inner wall of the tubular body and with the annular flange seating against an annular top end edge surface of the tubular body; and firing the tubular body and the first loose-fit T-plug to shrink fit the tubular body and the loose-fit T-plug to interfuse the loose-fit T-plug with the upper end of the tubular body in a manner which results in a monolithic body, wherein said firing comprises rapidly raising the temperature of the tubular body and the loose-fit T-plug at a rate of greater than 500.degree. C./minute.

2. A method as set forth in claim 1, further comprising using the loose-fit T-plug as a thermal buffer to obviate stress being induced in the monolithic body by the firing.

3. A method as set forth in claim 1, wherein, before firing, a clearance between the cylindrical portion and the inner wall of the tubular body is selected to be between 0.2 and 0.4 mm.

4. A method as set forth in claim 1, wherein the firing rapidly raises the temperature of the tubular body and the loose-fit T-plug.

5. A method as set forth in claim 4, wherein the tubular body and the cylindrical portion are supported on a pedestal of a conveyor belt and are transported through a furnace which induces the rapid rise in temperature.

6. A method of as set forth in claim 5, comprising forming the pedestal of a material selected to have predetermined thermal properties with respect to the thermal properties of the second loose-fit T-plug and using the pedestal of the conveyor belt as a thermal buffer for a lower end of the discharge tube during firing.

7. A method as set forth in claim 5, wherein the pedestal is formed of the same material as the tubular body and has been, before firing, sintered to a density which is approximately that of the metal halide discharge tube after firing.

8. A method as set forth in claim 1, wherein the firing comprises rapidly raising the temperature of the tubular body and the loose-fit T-plug at a rate of about 1000.degree C/minute.

9. A method as set forth in claim 1, further comprising disposing a second loose-fit T-plug in a lower open end of the cylindrical portion prior to the step of firing.

10. A method as set forth in claim 9, further comprising using the second loose-fit T-plug as a thermal buffer.

11. A method as set forth in claim 9, wherein at least the second loose-fit T-plug has a stem portion and further comprising disposing the tubular body and the second loose-fit T-plug on a pedestal of a conveyor belt so that the stem portion of the second loose-fit T-plug is disposed through an aperture formed in the pedestal.

12. A method of forming a metal halide discharge tube comprising:

arranging a tubular body in an essentially vertical orientation;

disposing a first loose-fit T-plug having a stem portion, a cylindrical portion and an annular flange in an upper open end of the tubular body so that the cylindrical portion of the first loose-fit T-plug is disposed within the open end of the tubular body in a contact-free, spaced relation with an inner wall of the tubular body and with the annular flange seating against an annular top end edge surface of the tubular body;

disposing a second loose-fit T-plug in a lower open end of the cylindrical portion, wherein the second loose-fit T-plug has a stem portion;

disposing the tubular body and the second loose-fit T-plug on a pedestal of a conveyor belt so that the stem portion of the second loose-fit T-plug is disposed through an aperture formed in the pedestal;

firing the tubular body, the first loose-fit T-plug and the second loose-fit T-plug to shrink fit the tubular body, the first loose-fit T-plug and the second loose-fit T-plug to interfuse the first loose-fit T-plug with the upper end of the tubular body and to interfuse the second loose-fit T-plug with the lower end of the tubular body in a manner which results in a monolithic body.

13. A method as set forth in claim 12, further comprising using the loose-fit T-plug and the second loose-fit T-plug as thermal buffers to obviate stress being induced in the monolithic body by the firing.

14. A method as set forth in claim 12, wherein firing, comprises rapidly raising the temperature of the tubular body, the loose-fit T-plug and the second loose-fit T-plug at a rate of greater than 500.degree C/minute.

15. A method as set forth in claim 12, wherein the firing comprises rapidly raising the temperature of the tubular body, the loose-fit T-plug and the second loose-fit T-plug at a rate of about 1000.degree C/minute.

16. A method of forming a metal halide discharge tube comprising:

arranging a tubular body in an essentially vertical orientation;

disposing a first loose-fit T-plug having a stem portion, a cylindrical portion and an annular flange in an upper open end of the tubular body so that the cylindrical portion of the first loose-fit T-plug is disposed within the open end of the tubular body in a contact-free, spaced relation with an inner wall of the tubular body and with the annular flange seating against an annular top end edge surface of the tubular body;

disposing a second loose-fit T-plug in a lower open end of the cylindrical portion, wherein at least the second loose-fit T-plug has a stem portion;

disposing the tubular body and the second loose-fit T-plug on a pedestal of a conveyor belt so that the stem portion of the second loose-fit T-plug is disposed through an aperture formed in the pedestal;

firing the tubular body and the first loose-fit T-plug to shrink fit the tubular body and the loose-fit T-plug to interfuse the loose-fit T-plug with the upper end of the tubular body in a manner which results in a monolithic body, wherein said firing comprises rapidly raising the temperature of the tubular body and the loose-fit T-plug at a rate of greater than 500.degree. C./minute.

* * * * *